US008585042B2

(12) United States Patent
Colston et al.

(10) Patent No.: US 8,585,042 B2
(45) Date of Patent: Nov. 19, 2013

(54) CONTROLLING A PICK MECHANISM OF A MACHINE FOR HANDLING SHEET MEDIA

(75) Inventors: Scott L. Colston, Dundee (GB); Douglas L. Milne, Dundee (GB)

(73) Assignee: NCR Corporation, Duluth, GA (US)

( * ) Notice: Subject to any disclaimer, the term of this patent is extended or adjusted under 35 U.S.C. 154(b) by 0 days.

(21) Appl. No.: 13/250,182

(22) Filed: Sep. 30, 2011

(65) Prior Publication Data

US 2013/0082435 A1 Apr. 4, 2013

(51) Int. Cl.
*B65H 3/06* (2006.01)

(52) U.S. Cl.
USPC ..... 271/117; 271/270; 271/118

(58) Field of Classification Search
USPC ..... 271/117, 118, 270
See application file for complete search history.

(56) References Cited

U.S. PATENT DOCUMENTS

| | | | | |
|---|---|---|---|---|
| 4,066,941 | A * | 1/1978 | Foster | 388/809 |
| 4,414,496 | A * | 11/1983 | Watanabe et al. | 318/696 |
| 6,607,321 | B2 * | 8/2003 | Markham | 400/582 |
| 2007/0138733 | A1 * | 6/2007 | Gray | 271/18 |

* cited by examiner

*Primary Examiner* — Luis A Gonzalez
(74) *Attorney, Agent, or Firm* — Michael Chan

(57) ABSTRACT

A pick mechanism is described. The pick mechanism comprises: a movable pick component; a stepper motor; and, a stepper motor controller. The stepper motor is operably connected to the pick component to drive the pick component in a sequence of movements, and each movement involves the pick component travelling in one direction between one position and another position in a required time. The controller produces control signals that control the motor such that the pick component is driven during a movement at or close to the minimum rate of acceleration required to complete the movement in the required time.

11 Claims, 3 Drawing Sheets

OPTIMIZED PROFILE

CONTROLLING A PICK MECHANISM OF A MACHINE FOR HANDLING SHEET MEDIA

FIELD OF INVENTION

The invention relates to a machine for handling sheet media. In particular, the invention relates to picking means for such a machine.

BACKGROUND OF INVENTION

A machine for handling sheet media may comprise storage means, transport means and picking means. The storage means may comprise a number of cassettes, each holding a stack of sheet media. The transport means may comprise a transport mechanism for transporting the sheet media to a dispensing slot. The picking means may comprise a number of pick mechanisms, each associated with a one of the cassettes. Each mechanism may have a movable pick component, such as a pivoting arm, provided with means for holding individual sheets of media. The pick component picks individual sheets from its associated cassette and transfers them to the transport means.

An automated teller machine (ATM) is an example of such a machine. It handles sheet media in the form of currency notes. Each cassette may hold a stack of notes of a particular denomination. One of its roles is to dispense the notes.

Some machines have only a single, main motor driving all of machine's mechanisms. Moreover, some machines have the motor permanently engaged with all of the mechanisms. This means that every mechanism is driven each time a drive demand is placed by any one of the mechanisms. So, for example, in the case of an ATM, during any one dispensing operation, less than all the picking mechanisms may need to be driven, say, because, notes from all the cassettes may not be required; nevertheless, all of the picking mechanisms will be driven, which is inefficient and places a high torque or load demand on the motor. Moreover, the main motor is typically an AC motor, but, because AC mains voltages vary across the world, the motor has to be specific to the country in which the machine will be used, which has inventory implications.

A number of pick mechanisms have been proposed. One pick mechanism uses pneumatic force. An arm has a suction cup at one end. The arm pivots about a support in either of two directions between various positions each defined by an angle of the arm with respect to a reference axis. Each pick operation involves the arm being driven in a sequence of movements from a rest position to a pick position, at which the arm takes hold of the top sheet in the associated stack by applying suction to the cup; to a presentation position, at which the transport mechanism can take hold of the sheet, whereupon the suction is released; and, back to the pick or rest positions. In order for the machine to meet its specifications, particularly as regards pick rate, each movement has to be completed in a minimum time.

The pivoting of the pick mechanism arm may be controlled by a cam which is driven by the main motor. A cam follower, integral with the arm, follows a cam track in the cam. The characteristics of the motion of the arm, such as its position, velocity, acceleration, travel and dwell times, known as the pick profile, are a function of the form of the cam track. For the arm to successfully take hold of any particular type of media, the pick profile must be suitable for that media. The density of media, its substrate, weight, quality and dimensions can all affect the pick profile, which means that pick profiles may be quite different from media to media. In addition, any one sheet in a stack may have an irregularity, such as a hole, which means that a pick profile suitable for every other sheet in the stack may not be suitable for that one sheet. The result may be that the arm may not be able to take hold of that sheet.

The cam track of a cam based pick mechanism control is fixed, which means that the pick profile is fixed. Consequently, if the pick profile of a particular pick mechanism turns out not to be suitable for the media stored in its associated cassette, or any one sheet of media in its cassette, there is little that can be done to vary the control. For example, if the pick profile is unsuitable for one sheet because it has a hole in it and the arm fails to take hold of the sheet at the first attempt, all the pick mechanism can do is retry until, hopefully, it successfully takes hold of the sheet. Ideally, the pick profile would be variable. For instance, a hole in a sheet may necessitate the suction cup extending further into the cassette holding that sheet or maintaining initial contact with the sheet for longer. If the arm cannot take hold of the sheet, operator intervention may be required. If the pick profile is totally unsuitable for the media stored in the associated cassette, the mechanism may have to be changed for a mechanism with a more suitable profile.

It has been proposed, such as, for example, in EP-A-1798694, to replace each main motor-driven cam with an independent stepper motor controlled by an independent stepper motor controller. This decreases the load on the main motor, which continues to drive other mechanisms, and improves efficiency in that each pick mechanism may be operated individually, in isolation from all other mechanisms. In addition, the variable control offered by a stepper motor means that the pick profile of each pick mechanism is independently adaptable. Consequently, by altering the control of a stepper motor, the pick profile of the pick mechanism of which the stepper motor is a component can be adapted to suit the sheet media in the associated cassette without having to change the pick mechanism, or to improve the chances of the pick mechanism taking hold of any one particular sheet, when retrying to take hold of it following a failed first attempt. Also, stepper motors can be very precisely controlled, which is advantageous, and, because they are DC driven, they are not country specific.

However, the high acceleration demands of a pick mechanism and the likelihood of stalling due to the forces associated with picking can be a problem for stepper motors.

SUMMARY OF INVENTION

According to a first aspect, the invention provides a pick mechanism comprising:

a movable pick component;

a stepper motor; and, a stepper motor controller;

wherein the stepper motor is operably connected to the pick component to drive the pick component in a sequence of movements;

wherein each movement involves the pick component travelling in one direction between one position and another position in a required time; and, wherein the controller produces control signals that control the motor such that the pick component is driven at or close to the minimum rate of acceleration required to complete the movement in the required time.

Torque is proportional to acceleration, so by keeping the rate of acceleration at or close to the minimum necessary to complete the movement in the required time, torque is kept low, which reduces the likelihood of stalling. The phrase "close to" should be understood to mean not so much greater than the minimum possible rate of acceleration as to reach a point at which stalling of the stepper motor is likely to occur.

It has been shown that pick mechanisms according to the first aspect of the invention are less likely to stall, even if the pick rate is increased as compared to prior art mechanisms.

Another way of looking at the invention is in terms of the velocity of the pick component. As the magnitude of the pick component acceleration is kept substantially constant, the velocity of the pick component gradually varies during a movement. In contrast, prior art stepper motor mechanisms are driven substantially at a constant velocity, which tends to be the maximum possible so as to cover the necessary distance in the least possible time. Consequently, stalling is a problem.

The movement is preferably divided into two phases, an initial phase and a final phase, and control signals are produced such that the pick component is accelerated with positive acceleration during the initial phase and with negative acceleration, or deceleration, during the final phase. It has been found to be beneficial in relation to preventing stalling for the pick component to be slowing down and coming to rest as it comes to the end of a movement. This is particularly the case in relation to the movement which ends with the pick component coming into contact with a stack of sheet media, at which point the greatest load is applied to the stepper motor, so stalling is most likely.

Preferably, the initial phase is equal to half of the required time with the acceleration rate during the initial phase calculated based on the rate required to complete half the movement in half of the required time, and the deceleration during the final phase is equal to the negative of the acceleration during the initial phase. It has been found that dividing the movement in half, into equal initial and final phases, is particularly effective in terms of minimizing the acceleration rate. In addition, calculating the acceleration and deceleration rates in this way is especially efficient when it comes to programming the stepper controller because separate, detailed instructions are not required for both the acceleration and deceleration calculations; the deceleration rate is simply the negative of the acceleration rate. The demands on programming resources are therefore kept low.

Each movement may further comprise at least one intermediate phase, between the initial phase and final phase, during which the acceleration rate of the pick component may be the same as or different to any of the other phases.

The pick component may be required to dwell in any position. For example, in the picking position it is advantageous for the pick component to remain in contact with the top sheet of media for a protracted period to ensure that the component has a good hold of the sheet. Consequently, in addition to any phases, a movement may be preceded or followed by a period during which the pick component remains stationary.

The pick component may comprise an arm pivotally mounted on a support. An arm is one particularly preferred type of pick component, but a number of other types are equally applicable.

The stepper motor may have a drive shaft on which a gear may be mounted, the arm may be provided with a complementary gear and the gear and the complementary gear may be engaged so as to operably connect the stepper motor and the arm. The use of gears is a particularly preferred way of operably connecting the stepper motor to the pick component, but other ways, such as a belt, are equally applicable.

The pick component may comprise a pneumatic mechanism for holding sheet media. Pneumatic mechanisms are a particularly preferred way of holding sheet media, but other ways are equally applicable.

According to a second aspect, the invention provides a machine for handling sheet media, particularly an ATM, comprising a pick mechanism according to a first aspect of the invention According to a third aspect, the invention provides a method of operating a pick mechanism comprising:

a movable pick component driven in a sequence of movements;

wherein each movement involves the pick component travelling in one direction between one position and another position in a required time;

the method comprising:

driving the pick component during a movement at or close to the minimum rate of acceleration required to complete the movement in the required time.

Each movement may include an initial phase and a final phase, and the pick component may be driven with positive acceleration during the initial phase and with negative acceleration during the final phase.

The initial phase may be equal to half of the required time with the acceleration rate during the initial phase calculated based on the rate required to complete half the movement in half of the required time and the deceleration during the final phase equal to the negative of the acceleration during the initial phase.

Each movement may further comprise at least one intermediate phase, between the initial phase and final phase, during which the rate of acceleration of the pick component is increased, decreased or substantially constant.

Any phase may be preceded or followed by a period when the pick component does not accelerate.

The pick mechanism may further comprise: a stepper motor; and a stepper motor controller; wherein the stepper motor is operably connected to the pick component to drive the pick component in the sequence of movements; and wherein the controller executes instructions with which it is programmed, which cause the controller to produce control signals that control the motor.

BRIEF DESCRIPTION OF THE DRAWINGS

The invention will now be described, by way of example, with reference to the following drawings, in which.

DETAILED DESCRIPTION

Figure 1:
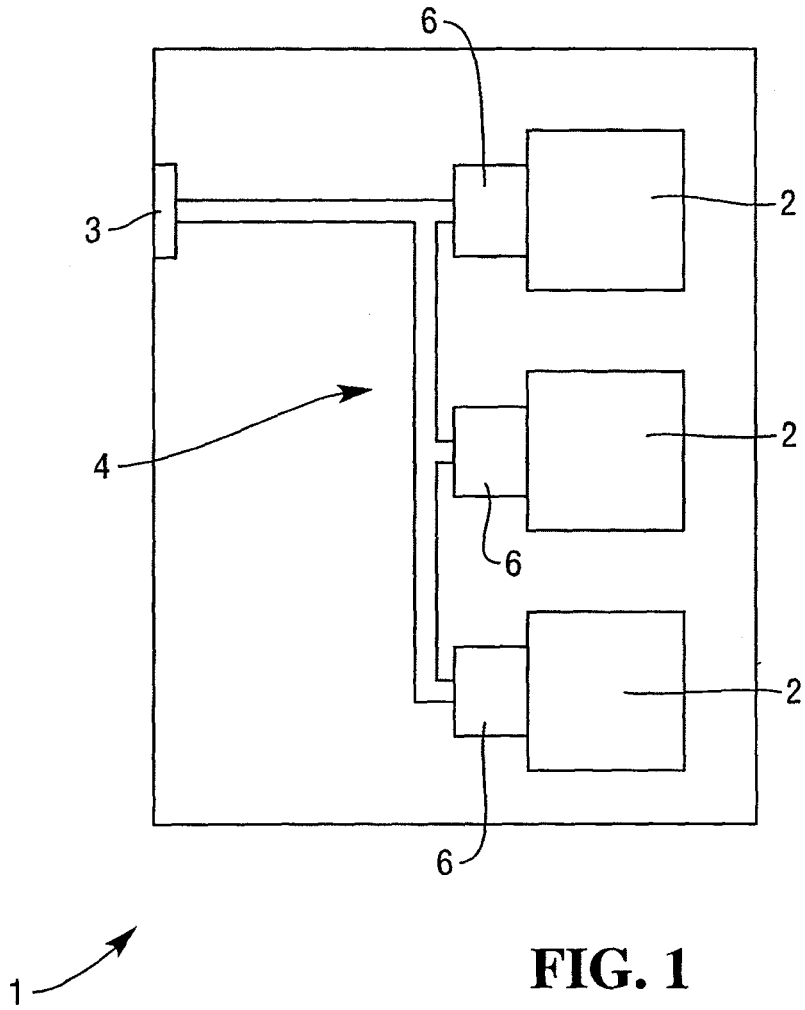
FIG. 1 is a schematic representation of an ATM.

With reference to FIG. 1, an ATM, indicated generally at 1, comprises a plurality of cassettes 2 each storing a stack of one of a range of denominations of currency notes (not shown). One role of the ATM is to dispense the notes. A transport mechanism 4 conveys notes from each of the cassettes 2 to a dispensing slot 3, possibly via an aggregator (note stacker or note buncher) mechanism (not shown). A pick mechanism 6 is associated with each cassette 2. Each pick mechanism 6 picks notes one at a time from its associated cassette 2 and presents the notes to the transport mechanism 4.

By way of example, a single transaction may involve the ATM 1 dispensing a bunch of notes made up of one note from each cassette 2. Each pick mechanism 4 simultaneously picks one note from its associated cassette 2, transfers the note to the transport mechanism 6, which transports the note to the dispensing slot 3.

Figure 2:
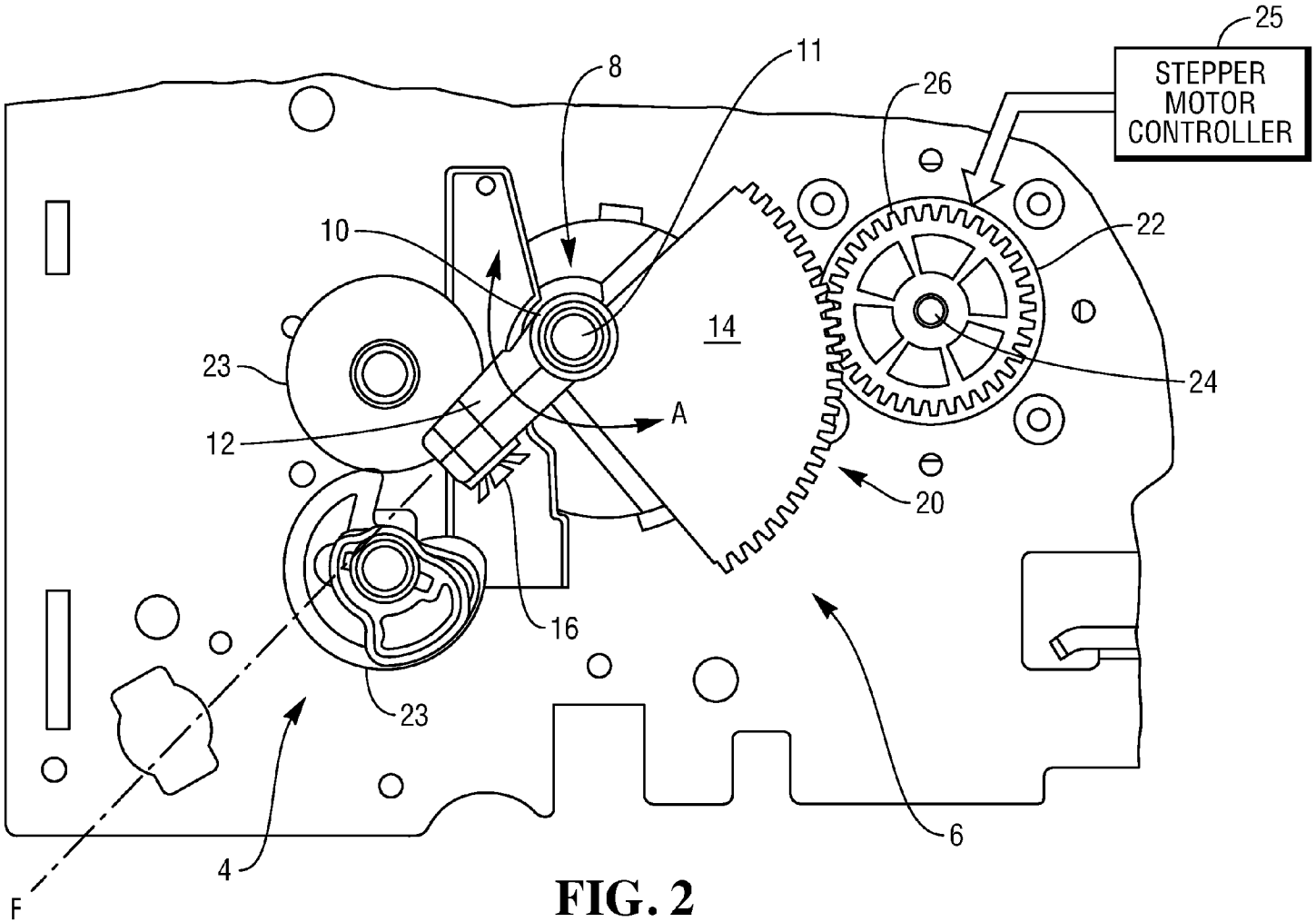
FIG. 2 is a side view of a pick mechanism according to the invention.

With reference to FIG. 2, each pick mechanism 6 comprises an arm, indicated generally at 8, having a cylindrical part 10, an elongate rod-like part 12 and a quadrant shaped plate member 14. The cylindrical part 10, which acts as a bearing, is received on an axle 11, about which it is rotatable. In effect, the axle 11 serves as a support for the arm 8. The rod-like part 12, which is integral with the cylindrical part 10, extends generally perpendicularly to the axis of rotation of the axle 10. A suction cup 16 is mounted at an end of the rod-like part 12, opposite to the cylindrical part 4. The plate member 14, which is also integral with the cylindrical part 10, also extends generally perpendicularly to the axle 10, albeit in a generally opposite direction to the rod-like part 12. The arcuate edge 20 of the member 8 is provided with teeth.

The transport mechanism 4 comprises a pair of opposed pinch rollers 23, which are at are an entrance to a conveying system (not shown).

A stepper motor 22 has a drive shaft 24. The stepper motor 22 is controlled by a stepper motor controller 25. A complete revolution of the shaft 24 is divided into steps, and each step corresponds to an angular position of the shaft 24. The controller 25 precisely controls the angular position of the shaft 24. It executes a set of instructions with which it is programmed. The instructions cause the controller 25 to produce control signals that control the motor 22 so as to rotate the shaft 24, either clockwise or anticlockwise, from one position to another. The instructions, and the control signals produced as a result, dictate the acceleration and velocity of the shaft 24 and its position and time of travel.

Fixedly mounted on the shaft 24 is a gear 26. The teeth of the gear 26 engage the teeth of the plate member 14 so as to operably connect the shaft 24 and the arm 8. In other words, the motor 22 drives the arm 8. Rotation of the gear 26 brings about a corresponding rotation of the plate member 14. This rotation translates into a pivoting motion of the rod-like part 12.

The extremities of the pivoting motion of the rod-like part 12 are dictated by the length of the arcuate edge 20. The extreme positions of the rod-like part 12 and any position in between are defined by the angle between the elongate axis F of the rod-like part 12 and a reference axis, such as the vertical or horizontal. For each angular position of the drive shaft 24, there is a corresponding angular position of the rod-like part 12.

During any one pick operation, wherein a note is picked by a pick mechanism 4 from its associated cassette 2 and presented to the transport mechanism 21, the rod-like part 12 undergoes a sequence of movements. Each movement involves the rod-like part 12 travelling in one of the two possible directions, shown by the arrow A, from one position to another. Typically, the rod-like part 12 travels from a rest position to a picking position, where the rod-like part 12 is positioned such that the suction cup 16 is in contact with the top note in the stack of notes in the associated cassette 2; to a presentation position, where the note held by the arm 8 is presented to the transport mechanism 4; and, back to the rest position. In the picking position, suction is applied to the suction cup 16 so as to take hold of the top note. The arm 8 may dwell in the picking position to ensure that the suction cup 16 has a good hold of the note. Suction is maintained until the presentation position, where the rod-like part 12 may again dwell to ensure satisfactory transfer to the transport mechanism 4. Suction is released when the transport mechanism 4 has taken hold of the note between the pinch rollers 23.

The characteristics of motion of the arm 8, such as, for instance, position, velocity, acceleration, time of travel or dwell time, otherwise known as the pick profile, are dictated by the way in which the stepper motor 24 is controlled. Acceleration of the stepper motor shaft 24 translates into acceleration of the arm 8. In order to meet the specifications for the ATM, each pick mechanism 6 must be able to complete each movement within a required time, which is governed by the required pick rate and synchronization with the pinch rollers 23 of the transport mechanism 4.

Figure 3:
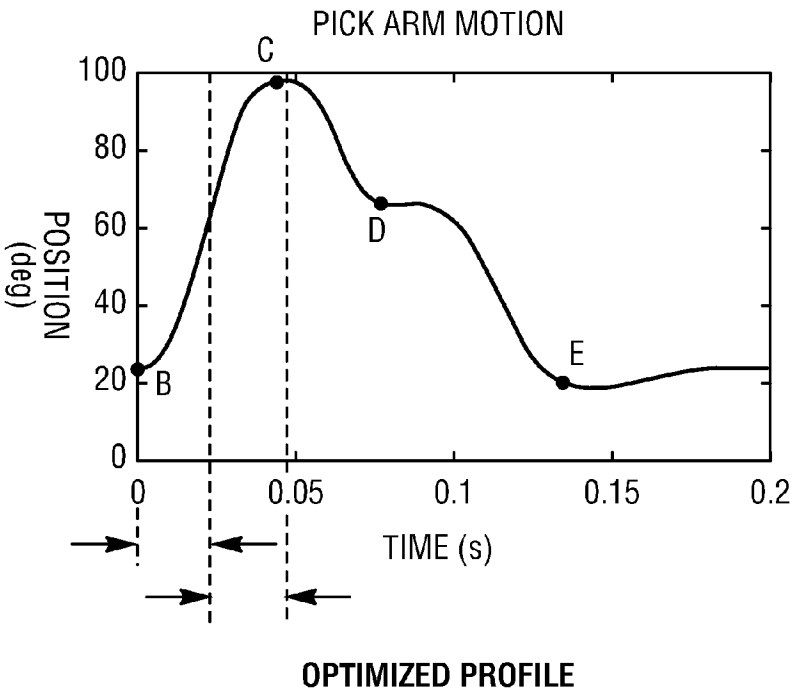
FIG. 3 is a graph of a pick profile of a pick mechanism according to the invention; and, FIG. 4 is a graph of a pick profile of a prior art pick mechanism.

With reference to FIG. 3, as already stated, a pick operation involves a sequence of movements. Each movement involves the arm 8 travelling in one direction between one position and another position. Again, as already stated, each position of the arm 8 is identified as its angular position with respect to a reference axis. The graph plots the pick profile of the arm 8 in terms its angular position with time as it goes through a pick operation. The section between points B and C of the plot represents the movement of the arm in one direction from an angular position of approximately 20° to an angular position of approximately 100° in a time of approximately 0.05 seconds. During this movement, the arm 8 travels from the rest position (point B) to the picking position (point C).

It can be seen that the rate of change of position, that is, the velocity, of the arm 8 during the movement is gradually varied; that is, the plot is curved in parts, with the slope of the curve changing, and not substantially linear. This variation in velocity is a consequence of the way in which the arm 8 is accelerated during the movement. Similarly, the sections of the plot between points C and D and points D and E, representing the subsequent movements of the arm 8, are curved in parts and not substantially linear. Point C corresponds to the picking position and point D corresponds to the presentation position.

The rate of acceleration, a, of the arm in moving from position B to position C in a time, tC, is defined by the equation:

$$a = -4 \cdot \frac{(pos_B - pos_C)}{tC_{sec}^2}$$

which is derived from:

$$pos_C = pos_B + a \cdot \left(\frac{tC_{sec}}{2}\right)^2$$

In a preferred embodiment, the minimum acceleration required to move the arm half of the distance of a movement in half of the required time for the movement is calculated. The movement is divided into an initial phase α and a final phase Ω. The controller produces control signals that control the motor 24 such that the arm 8 is accelerated during the initial phase α by the calculated acceleration rate and decelerated during the final phase Ω by the negative of the calculated acceleration rate. In other words, the magnitude of the rate of acceleration is the same during both the initial phase α and the final phase Ω, but the acceleration is positive during the initial phase α and negative during the final phase Ω. As a consequence, the velocity of the arm gradually increases during the initial phase α and gradually decreases during the final phase Ω.

An aim of the invention is to minimize acceleration so as to minimize torque. It has been found that accelerating the arm for 50% of the minimum time enables the arm to travel with the lowest possible acceleration rate whilst still travelling the necessary distance in the required time. So, in the preferred embodiment, control signals are produced that accelerate the arm for 50% of the minimum time and decelerate the arm for the other 50% of the minimum time. It has been found to be beneficial as regards the avoidance of stalling to decelerate the arm and for it to be slowing down and coming to rest as it reaches the end of a movement.

Figure 4:
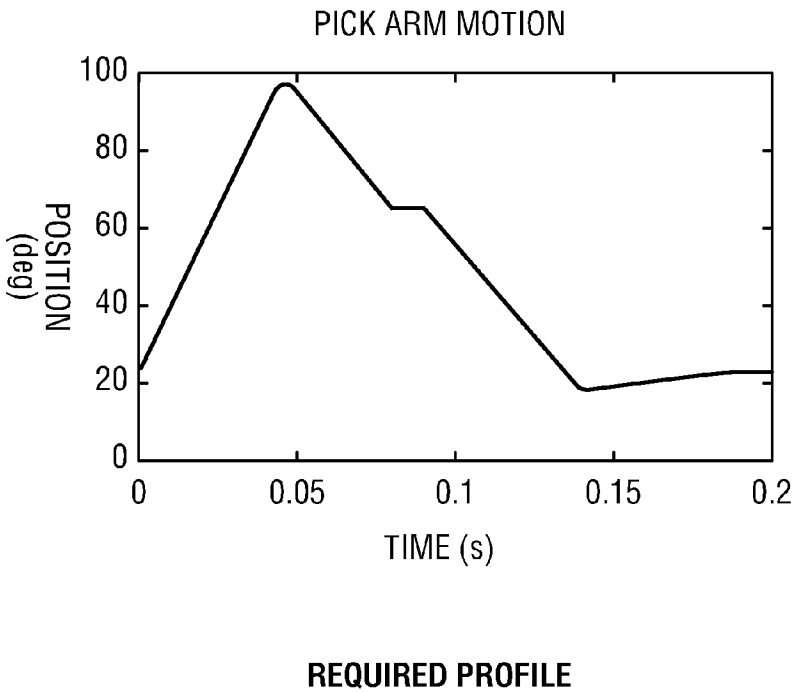
FIG. 4 PRIOR ART

In FIG. 4, which illustrates the pick profile of a prior art stepper motor, it can be seen that, in contrast to FIG. 3, during any movement, the rate of change of position of the arm, that is, its velocity, is substantially constant; that is, the parts of the graph representing each of the movements of the arm are each substantially linear, with the slope remaining constant. In other words, any movement is achieved with maximum acceleration chosen so as to make the arm travel at the maximum possible velocity between the start and end positions of the movement.

Returning to the embodiment, any movement may include at least one intermediate phase (not shown), between the initial phase $\alpha$ and the final phase $\Omega$, during which the rate of acceleration may be increased, decreased or kept substantially constant.

As previously mentioned, it may also be preferable for the arm 8 to dwell at any position. See, for example, point D in FIG. 3, which corresponds to the arm 8 being at the presentation position. In that position, it is preferable for the arm 8 to dwell for a period whilst a note is transferred to the transport mechanism 4. Dwelling means that the arm does not change its position and does not accelerate, hence the flatness of the plot immediately following point D.

What is claimed is:

1. A pick mechanism comprising:

a movable pick component;

a stepper motor; and a stepper motor controller;

wherein the stepper motor is operably connected to the pick component to drive the pick component in a sequence of movements;

wherein each movement involves the pick component travelling in one direction between one position and another position in a required time;

wherein the controller produces control signals that control the motor such that the pick component is driven during a movement at or close to the minimum rate of acceleration required to complete the movement in the required time;

wherein each movement is divided into an initial phase and a final phase, and control signals are produced such that the pick component is driven with positive acceleration during the initial phase and with negative acceleration during the final phase; and wherein the initial phase is equal to half of the required time with the acceleration rate during the initial phase calculated based on the rate required to complete half the movement in half of the required time and the deceleration during the final phase equal to the negative of the acceleration during the initial phase.

2. A pick mechanism according to claim 1 wherein each movement further comprises at least one intermediate phase, between the initial phase and final phase, during which the rate of acceleration of the pick component is increased, decreased or substantially constant.

3. A pick mechanism according to claim 1 wherein any phase is preceded or followed by a period when the pick component does not accelerate.

4. A pick mechanism according to claim 1 wherein the pick component comprises an arm pivotally mounted on a support.

5. A pick mechanism according to claim 4 wherein the stepper motor has a drive shaft on which a gear may be mounted, the arm is provided with a complementary gear and the gear and the complementary gear are engaged.

6. An automated teller machine comprising a pick mechanism according to claim 1.

7. A method of operating a pick mechanism comprising a stepper motor, a stepper motor controller, and a movable pick component driven in a sequence of movements, wherein (i) each movement involves the pick component travelling in one direction between one position and another position in a required time, (ii) each movement includes an initial phase and a final phase, and the pick component is driven with positive acceleration during the initial phase and with negative acceleration during the final phase, and (iii) the initial phase is equal to half of the required time with the acceleration rate during the initial phase calculated based on the rate required to complete half the movement in half of the required time and the deceleration during the final phase equal to the negative of the acceleration during the initial phase, the method comprising:

driving the pick component during a movement at or close to the minimum rate of acceleration required to complete the movement in the required time.

8. A method of operating a pick mechanism according to claim 7 wherein each movement further comprises at least one intermediate phase, between the initial phase and final phase, during which the rate of acceleration of the pick component is increased, decreased or substantially constant.

9. A method of operating a pick mechanism according to claim 7 wherein any phase is preceded or followed by a period when the pick component does not accelerate.

10. A method according to claim 7 wherein the stepper motor is operably connected to the pick component to drive the pick component in the sequence of movements; and wherein the controller executes instructions with which it is programmed, which cause the controller to produce control signals that control the motor.

11. A method according to claim 10 wherein the method is performed by a computer having a memory executing one or more programs of instructions which are tangibly embodied in a program storage medium readable by the computer.

* * * * *